United States Patent [19]

Smeiman

[11] Patent Number: 5,016,059

[45] Date of Patent: May 14, 1991

[54] PHOTOCOPY MACHINE REMOTELY CONTROLLED COPY COUNTING SYSTEM

[76] Inventor: Wilfred Smeiman, 2120 Howell Ave., #403, Anaheim, Calif. 92806

[21] Appl. No.: 488,427

[22] Filed: Feb. 27, 1990

Related U.S. Application Data

[63] Continuation of Ser. No. 317,272, Feb. 28, 1989, abandoned, which is a continuation of Ser. No. 937,072, Dec. 7, 1986, abandoned.

[51] Int. Cl.[5] ..... G03G 15/00

[52] U.S. Cl. ..... 355/308; 340/825.17

[58] Field of Search ..... 340/310 R, 310 A, 825.06, 340/825.16, 825.17, 825.35; 355/308, 209

[56] References Cited

U.S. PATENT DOCUMENTS 3,641,536 2/1972 Prosprich .
4,133,420 1/1979 McManus .

FOREIGN PATENT DOCUMENTS 56-27160 3/1981 Japan .
59-101664 6/1984 Japan .

*Primary Examiner*—Joan H. Pendegrass
*Attorney, Agent, or Firm*—David O'Reilly

[57] ABSTRACT

A remote control system for providing accurate copy count and controlling in the operation of self-service photocopy machines. The system is comprised of a remotely located transmitter which can send digital signals to enable or disable selected self-serve photocopy machines. A receiver mounted on each photocopy machine controls a digital display which indicates the number of legal or letter size photocopies being made. A user operated switch on the receiver lets a user disable the copy machine when copying is complete. The photocopy machine is enabled by a reset signal sent from the remote transmitter which also clears the digital display. The receiver display and transmitter are adapted to a wide variety of existing photocopy machines by a universal interface circuit.

20 Claims, 4 Drawing Sheets

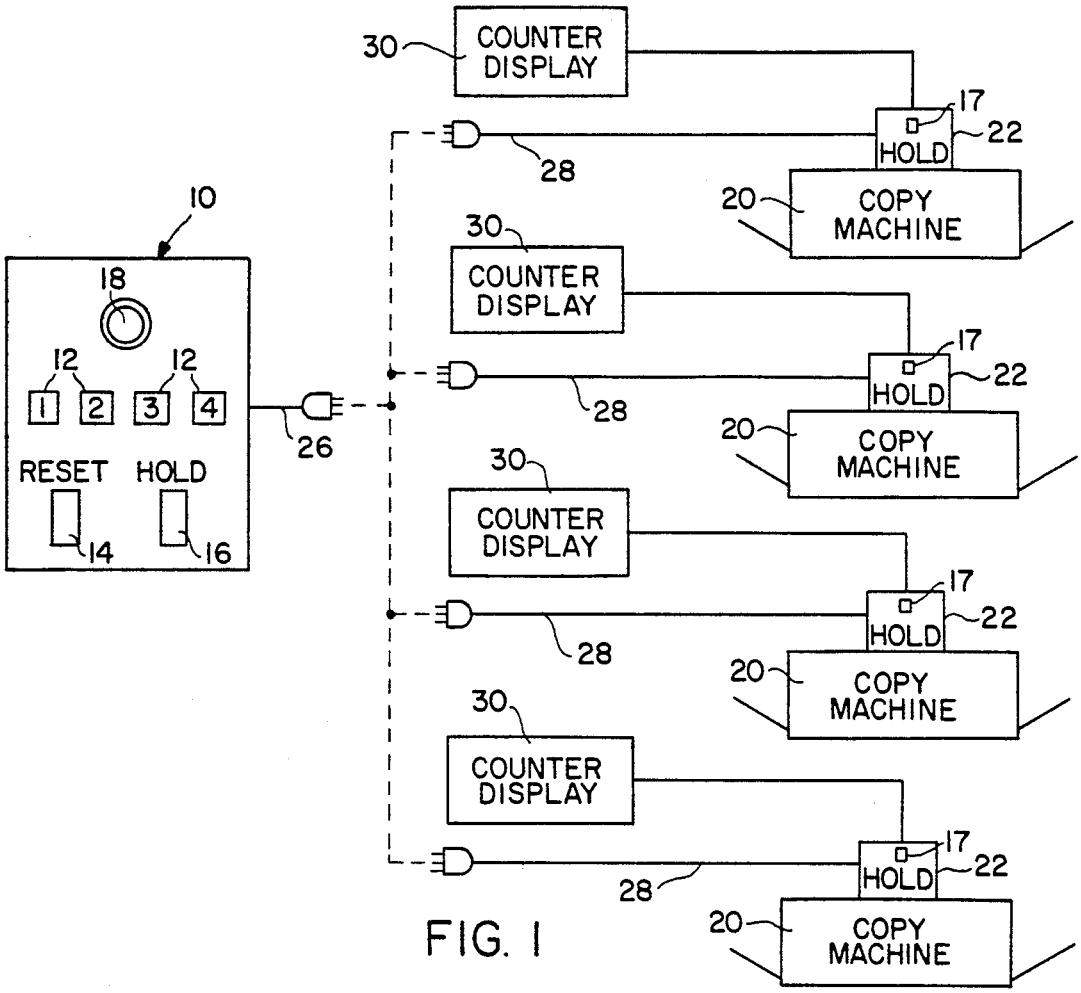
FIG. 1
FIG. 2
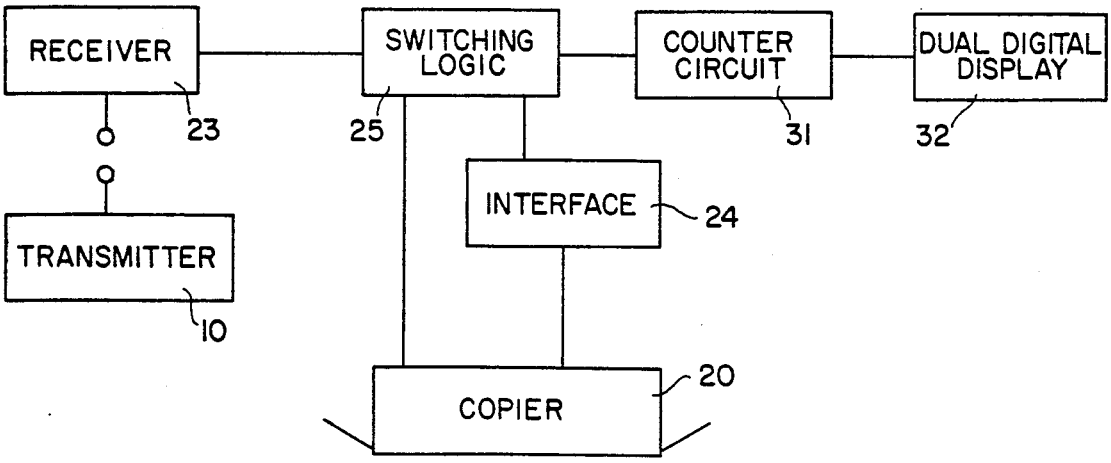

PHOTOCOPY MACHINE REMOTELY CONTROLLED COPY COUNTING SYSTEM

This is a continuation of co-pending application Ser. No. 07/317,272, filed on Feb. 28, 1989, which is a continuation of application Ser. No. 06/937,072, filed Dec. 7, 1986, both now abandoned.

FIELD OF THE INVENTION

This invention relates to Copy Machine Copy Counting Systems, and more particularly relates to a remotely controlled copy counting system for self-service copy machines.

BACKGROUND OF THE INVENTION

Many establishments now provide self-service copy machines which are operated either on a coin basis, or by payment for the number of copies used. The coin operated machines are adequate to protect against unauthorized copying, but are inconvenient, and costly for making large volumes of copies. The latter copy systems are found in stationery stores printing shops and book stores. These establishments have machines more suitable for making large volumes of copies, with payment usually on an "honor" system. After making the copies, the customer will bring the copies to the counter and tell the cashier, or store operator, the number of copies made. The problem is that the operator does not know exactly how many copies a customer has made.

A cashier or clerk could go look at the copy machine counter but this is a difficult and time consuming task as the counter is usually small and not easy to read. Even if a clerk were to go to a copy machine and read the counter, another customer may have started making copies, which makes an accurate reading time consuming and even more difficult. The clerk would then have to ask the second customer how many copies were made, and subtract those from the count shown on the copy machine counter. Moreover the clerk operator would have to record the count before and after the user makes the copies. Otherwise the clerk or cashier, must either count all the copies made if they don't go to the machine and record the actual count. What they do in most all cases, is depend upon the honesty of the customer to truthfully state the actual count. They usually have no choice as they are to busy to count all the copies the customer has made and even this may be inaccurate. The customer may have made poor quality or defective copies and simply discarded them before coming to the cashier. There is no present way of knowing. These inefficient methods mean losses to shop owners of amounts that have been estimated to reach hundreds of dollars a day, depending upon the copy volume and number of copy machines in the shop. Obviously the task is sufficiently difficult that it is more expedient to simply rely on a customers honesty.

Therefore, it is one object of the present invention to provide a method, accurate to counting the number copies made by customers in stores having self-serve photocopy machines.

Still another object of the present invention is to provide a store with a method of accurately determining the number of copies made on one or more copy machines without having to rely on customer or actually counting the copies.

Still another object of the present invention is to provide a method and apparatus for accurately determining the number of copies made on one or more copy machines which can be remotely controlled by a clerk in the a shop.

Still another object of the present invention is to provide a method and apparatus for indicating accurately the number of copies made on a photocopy machine disable the machine until the copies are recorded, or paid for.

Yet another object of the present invention is to provide a apparatus and method for determining accurately the number of copies made on a copy machine which gives a separate, accurate count of each copy size.

Still another object of the present invention is to provide a method of remotely controlling the operation of a copy machine from a convenient location, such as the cash register.

Yet another object of the present invention is to provide an apparatus and method for remotely controlling one or more copy machines to interrupt use of a copy machine until a copy count has been recorded and paid for by the customer.

Still another object of the present invention is to provide an apparatus and method for remotely determining accurate copy count for a copy machine which utilizes existing building wiring.

BRIEF DESCRIPTION OF THE INVENTION

The purpose of the present invention is to provide a remotely controlled system for keeping an accurate count of copies made on one or more customer operated self-serve copy machines. The method and apparatus of the present system solves the problems of keeping track of copies by providing stationery stores or print shops that have one or more photocopy machines with a wireless, solid state, remotely controlled system that counts every copy made, and also automatically differentiates between legal and letter size copies. Optionally other sizes and features such as reduction, fast feed, slow feed etc. can be monitored. This system includes a method for disabling a copy machine until the copy count has been recorded, or paid for.

The apparatus of the present invention is a system that cannot be tampered with by the customer, or copy machine user; nor can the copy count be altered or erased by the customer. Each copy is recorded and displayed on a large visual display clearly visible to the shop clerk or cashier and may be visible to the customer from the copy machine. When copying is completed the clerk knows exactly the quantity and price, which can be taken from a clearly visible accurate display without having to count copies or rely on the customer.

A distinct advantage of the present invention is that a clerk or cashier, is able to read the number of copies made from the a remote location regardless of the number of copy machines located in the store even if they are out of sight of the cashier. The operation of the system for counting the copies is totally automatic and involves only minimal time of the clerk and customer to receive payment. The accuracy of the system results in less time than usually taken for receiving payment for copies. Further since the copy count is extremely accurate, losses resulting from miscounts or dishonesty of the customer are eliminated.

Since the system uses existing building wiring for transmitter and receiver communication, no wires are necessary to connect the receivers at the photocopy machines to the transmitter/controller at the cash register greatly simplifying installation.

The remote transmitter which may be at the register, plugs into any existing 120 volt AC wall outlet, and is ready to transmit control signals to a receiver installed for each copy machine. The transmitter is under the control of the clerk or shop operator, and has switches for selecting the particular copy machine being controlled. A hold button on the transmitter places a hold on the machine selected until the copies have been recorded or paid for. The transmitter also includes a reset switch to clear the machine and display for the next customer after recording or payment for the copies made by the previous customer.

The receiver mounted on each copy machines responds to pulses sent by the transmitter through existing building wiring. Additionally, the receiver at the copy machine has a switch for putting copier on hold until the customer has paid for his copies. This protects the customer from being charged for copies made by another customer who might come along and use the machine while payment for the copies is being made. Once the customer has completed copies they press the hold switch on the receiver at the copy machine which freezes the count and disables the copy machine until the clerk resets it. The customer has no control over resetting the copier or restoring the copy machine on line.

The receiver is interfaced with the copy machine either by direct wiring to receive electrical pulses sent by the machine to its counter, or by a photodetector receiving an input from a light which illuminate each time a copy is made. Use of a photodetector avoids affecting copy machine warranties. The photodetector is mounted near a function light to respond to its output. The system is also designed to detect copy size selection by responding to paper tray selection. There is no reset button at the copier, so it is impossible for the customer to change or reset the counter before the cashier has recorded or received payment for the copies made. After use by the customer, pressing the hold switch will prevent use by anyone else until the cashier has recorded the count, received payment, and has reset the copy machine. The count recorded can not be accidently erased by the customer, or the cashier. It will register all copies made so the cashier can charge the customer and collect any money due.

An unusual feature of this invention is the use of the building power lines so that there are no unneeded wires or cables between the control station and the copy machines being controlled. The system uses existing building electrical wiring to transmit and receive signals which control copier functions and counting.

The system can also be easily adapted to self-service copiers used in office buildings from a room or cubicle anywhere in the building. Companies that require specific billing for clients, can now charge exact fees for copies made for each account. Copies can be made and remotely accounted for eliminating the need for each user having his own copy machine key.

The remote transmitter or controller is placed near the register for use by a clerk or cashier. The transmitting module is plugged into any conveniently available 120 volt AC wall power outlet, and with push button switches can select the particular copy machine to be controlled. For example, if the transmitter is controlling four machines and the switch for copier 1 is selected, pressing the reset switch will clear the counter for that machine. The copy machine digital display is then ready for use by another customer.

An important and necessary aspect of this invention is that all the controls for the copier, and all recording of the copies is accomplished remotely from a convenient central location by just a single operator with total control over all installed photocopy machines. Further, it should be understood that this control takes just seconds to complete.

The transmitter, receiver, and photo copier interface is designed for compatibility with any existing photocopy machines. Different photocopy machines operate at different voltage and power requirements. However, the interface circuit for this invention is designed to provide a constant output regardless of the input of the machine being used. The interface effectively isolates the count control system from operation of the photo copier itself, to prevent spurious or transient voltages on the line from effecting the count. After use the operator or cashier has complete control of the copier by being able to remotely reset the counter to zero and reactivate (enable) the photo copier without leaving the register. This is quickly and easily done by the cashier by simply pushing two buttons on the transmitter at the register. One button selects the photo copier to be reset, another reset button sends a pulse enabling the photo copier and resetting the count displayed to zero.

As an optional, but preferred feature of the invention, a receiver on each photocopy machine has two readouts, one for legal size and one for letter size as these are the most popular sizes used. Additional displays can be included for if desired. The counter display will automatically switch from one size read-out to the other when the customer selects either paper size. Optionally other features such as other paper sizes, reductions, enlargements etc. can be monitored. The operation during the selection of legal or letter size paper, or other monitored features, is totally automatic and does not involve any shop employee or customer's time.

As indicated above no direct wiring from the transmitter the receivers and counter is needed. The transmitter uses existing building wiring to communicate with the receiver and counter at each photocopy machine. Each transmitter may control sixteen photocopy machines or more from one location, such as the register.

These and other objects, advantages and novel features of this invention will be more fully understood from the following detailed description and accompanying drawings, in which:

BRIEF DESCRIPTION OF THE DRAWINGS

FIG. 1 is a simplified diagram of a copy machine remote controlled copy count system according to the invention.

FIG. 2 is a block diagram of the copy machine remote controlled copy count system of FIG. 1.

DETAILED DESCRIPTION OF THE INVENTION

Figure 3:
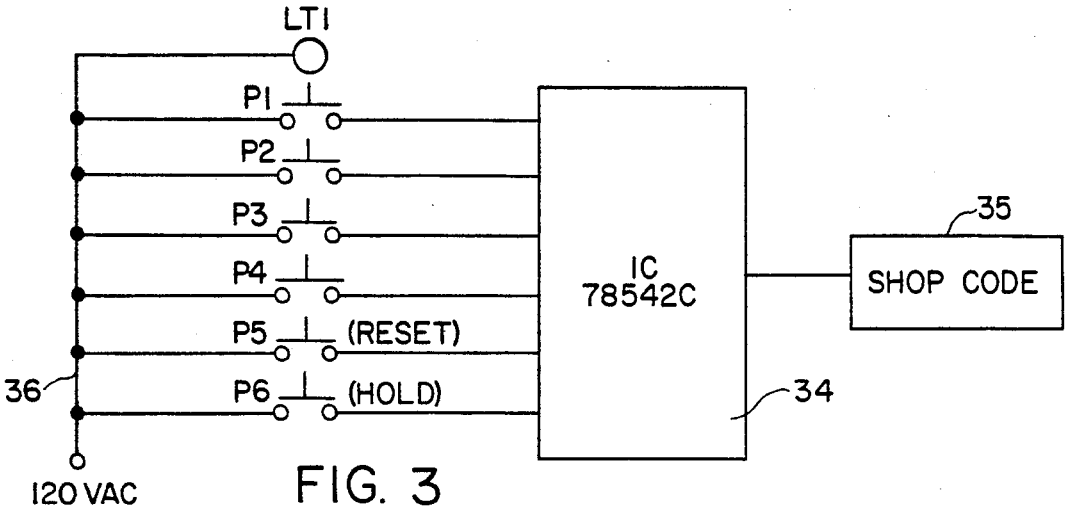
FIG. 3 is a diagram of the transmitter used in the invention.

A typical installation of the Remote Copy Counting System is illustrated generally in the pictorial diagram of FIG. 1, which illustrates a photocopy control system for four machines; but it should be understood that there could be any number of machines controlled from a single remote location. The system is comprised of a transmitter 10 located conveniently for use by a clerk or cashier. The transmitter has push button switches 12 for controlling four machines which are the average number that are usually found in stationery stores, print shops and book stores. The transmitter also has reset switch 14 and a hold switch 16. Indicator light 18 illuminates whenever any of the switches are operated to show a coded signal has been sent. A hold on any copy machine can be released by selecting the machine just b pressing one of switches 12 and then pressing switch 14 to reset the machine as will be described in greater detail hereinafter.

Photocopy machines 20 each have a receiver module 22 connected through an interface to monitor copies being made on the machine. Communication between the transmitter module 10 and receiver modules 22 is through existing building 110 volt AC power lines 26 and 28. The transmitter 10 and receiver 22 are plugged into convenient 120 volt AC outlets (not shown) which permit transmission over existing building power lines.

Counter and display 30 receives outputs from receiver 22 when the photocopy machine 20 is in operation through the interface circuit is connected to the copier circuitry receiving copier pulses whenever the copy button is activated.

The circuits for the copier control and counting are shown in the block diagram of FIG. 2. The receiver module 22 is comprised of a receiver 23, interface 24 and switching logic 25. Counter display is comprised of counter circuit 31 and dual digital display 38.

Interface circuit 24 (FIG. 2) is connected directly to photocopy machine wiring to detect pulses on the line that indicate when a copy is made and copy size by the paper tray in use. Copy counts in the form of pulses are output to display 30 are shown on displays 34 or 36 indicating the number of letter or legal size copies made. In late model copy machines the interface may be connected directly to a wiring harness called a "foreign equipment harness." Connection for copy count pulses and enable/disable pulses can be found on this harness. In older model copy machines direct connection to machine electrical wiring may be necessary.

The display is large enough to accomodate any size shop so it is clearly visible from the control location. A digital display having character sizes of about one inch will be clearly visible from several feet, usually from both the copy machine or the operator. Copy machines 20 can be located anywhere in the shop but display 30 must be clearly visible to the clerk or cashier from the position of transmitter 10. Most shops are small so that displays 30 are close enough to be seen from the copy machine by the customer and still be clearly visible to the shop clerk.

Transmitter 10 and receiver are a readily available control system for communicating through existing building power lines. The system has been adapted for use in the copy machine control and counting system. One such system which is suitable is a BSR Model X-10 or the like manufactured by BSR (USA) Limited, New York. The transmitter and receiver typically come with switches for programming the communicating codes. However for purposes of this invention the codes are fixed by defeating the ability to change codes by removal of the switches or preventing access. This prevents tampering by copy machine customers or shop clerks.

A typical transmitter 10 is illustrated in FIG. 2. The transmitter 10 has an integrated circuit (IC) 34 capable of transmitting digital information over existing building wires. Pushbutton switches PB1 through PB4 send a coded signal over line 36 representing the particular copy machine selected to be monitored or controlled. The coded signal is sent to the receiver on the machine selected. Output signals from IC 34 in the transmitter are sent through existing building 120 volt AC power lines. The output is a digital coded signal representing the particular receiver configured to respond to that code. Reset and hold coded signals are sent to the particular receiver activated by selecting one of switches PB1 through PB4. Light L1 indicates a code has been sent.

There are several types of interface functions for which various types of signals and sensors may be needed. There are photocopiers which generate a count pulse necessary to increment and update the counter of the digital display for each copy made. In addition a second pulse is sent to indicate the copy size being made. Preferably the most commonly used sizes are the legal and letter size copies in a two tray copier. A switching system provides for selection of either the legal size or letter size copy trays and provides a pulse output directing the copy pulses to the correct display. The interface system also provides a switching system to enable or disable the copier by interrupting use of the copy switch on the photo copier until the last user has paid for or accounted for their copies. The invention is not limited to legal or letter size copy readouts as other copy sizes and features could be monitored, such as reduction, enlargement, fast feed, slow feed etc.

Various makes and models of photo copier machines use different schemes and voltages for generating a count. Some machines generate 24 volt DC signals and others generate 120 volt AC signals, still others generate voltages somewhere between these. A few have a simple switch which is pulsed for each count output of the machine and no voltage is generated. The interface circuit of the invention is designed to handle all types of machines to provide a single universal output to the counting system of the invention. The interface circuit will process a wide variety of pulse signals produced by various machines with only slight modifications of the circuits. This simplifies installation and adaptation of the count system to a wide variety of machines as will be as described hereinafter.

Figure 5A:
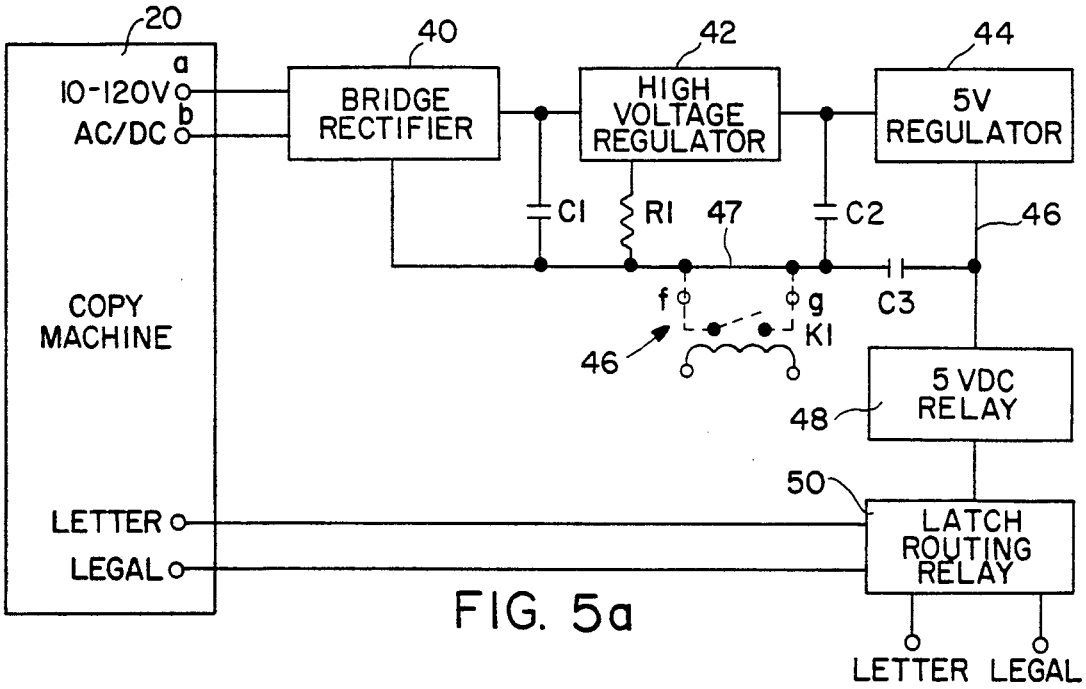
FIG. 5*a* is a schematic block diagram of the interface circuit of FIG. 7.

A circuit diagram of an interface circuit for use with most copy machines is shown in FIG. 5*a*. Terminals a and b connect to an AC or DC input at any voltage between 10 and 120 volts of existing photocopy machines. The pulse output from a photocopy machine applied to terminals a and b is rectified by bridge rectifier 40 which provides an output to high voltage regulator 42. The output of high voltage regulator 42 is then processed by 5 volt regulator 44 providing a 5 volt DC output at 46. Bridge rectifier 40 will provide a DC output always having the same polarity regardless of the polarity of the input on terminals a and b. If the input from the photocopy machine is DC it will have no effect on the output polarity of bridge rectifier 40. High voltage regulator 42 is adjusted to provide an output of about 24 volts with of resistor R1. The output of high voltage regulator 42 is then applied to the input of 5 volt regulator which provides a constant 5 volt output for any input voltage from 10 volts up to 40 volts.

As previously described, bridge rectifier 40 will provide a constant polarity output regardless of either an AC or DC input independent of any voltage, polarity or amplitude up to 120 volts at the input. High voltage regulator 42 is pe-set to a 24 volt DC output for any input up to 120 volts. The 24 volt output from high voltage regulator 42 will be reduced to a constant 5 volt DC by regulator 44 having a fixed, constant polarity. Thus, interface circuit 24 will provide a constant 5 volt DC output of fixed polarity for any input up to 120 volts, whether AC or DC, independent of the input polarity.

Figure 5B:
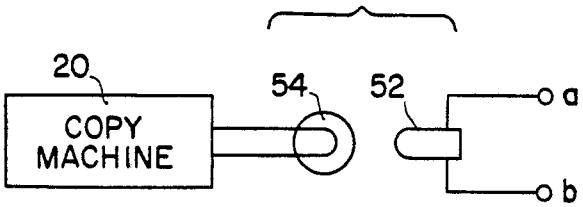
FIG. 5*b* is an alternate circuit for use in the interface circuit of FIG. 5*a*.

The optional circuit of FIG. 5*b* is for use where a machine warranty prevents direct connection to a machine wiring. To prevent voiding a machine warranty interface circuit 24 may be optionally connected to the machine by using a photodetector 52 to detect when a particular copy sequence is started. In some photocopy machines indicator light 54 lights up each time a copy is made to indicate to a user that the copy machine is in operation and copies are being made. Photodetector 52 connected to terminals a and b of the interface circuit is activated each time light 54 turns on. An output pulse from photodetector 52 is applied to input rectifier 40. This method can also be used to determine copy size by detecting when a copy size light comes. A pair of photodetectors can be used or a single photodetector indicating the presence or absence of light with a switch to change the display can be used.

In some photocopiers count pulse outputs are generated by an on/off relay switch (not shown) having no power output. For this type of photo copier, an optional count pulse relay (K1) 46 connected across points f and g is added and the connection at 48 removed from the circuit. With the configuration shown a voltage input at a and b will produce a 5 volt output of fixed polarity if count pulse relay 46 is now pulsed.

The interface circuit disclosed and described above detects when the copy machine is in operation. In addition the circuit also detects a copy size by the paper tray in use. This circuit may utilize another sensing method which might be called "magnetic sensing." In the magnetic sensing method (not shown) a solid state magnetic field sensor produces a voltage output when it senses a magnetic field. This output switches a routing circuit such as relay 50 sending an output to the counter system to indicate either one of two paper sizes from 5 VDC relay 48. A magnetic sensor can be used to either sense mechanical movement of a small magnet attached to some mechanical part of the copier whose position is near the respective paper trays in use. Another option is to sense the absence of presence of a magnetic field generated by some component (such as a magnetic clutch) which is on or off dependent upon which paper tray (i.e. paper size) is in use. Preferably direct connection to voltages produced when the machine is switched from one size to another are used to operate relay 50.

Each receiver module 22 has a hold pushbutton switch 17 corresponding to hold switch 16 on the transmitter. Hold switch 17 sends an interrupt signal to interrupt the copier operation to prevent copies being made until the previous user has paid or accounted for his copies and the system has been reset. Interruption is provided by disabling the print or copy button on the copy machine through a switch connected to the wiring harness.

Figure 6:
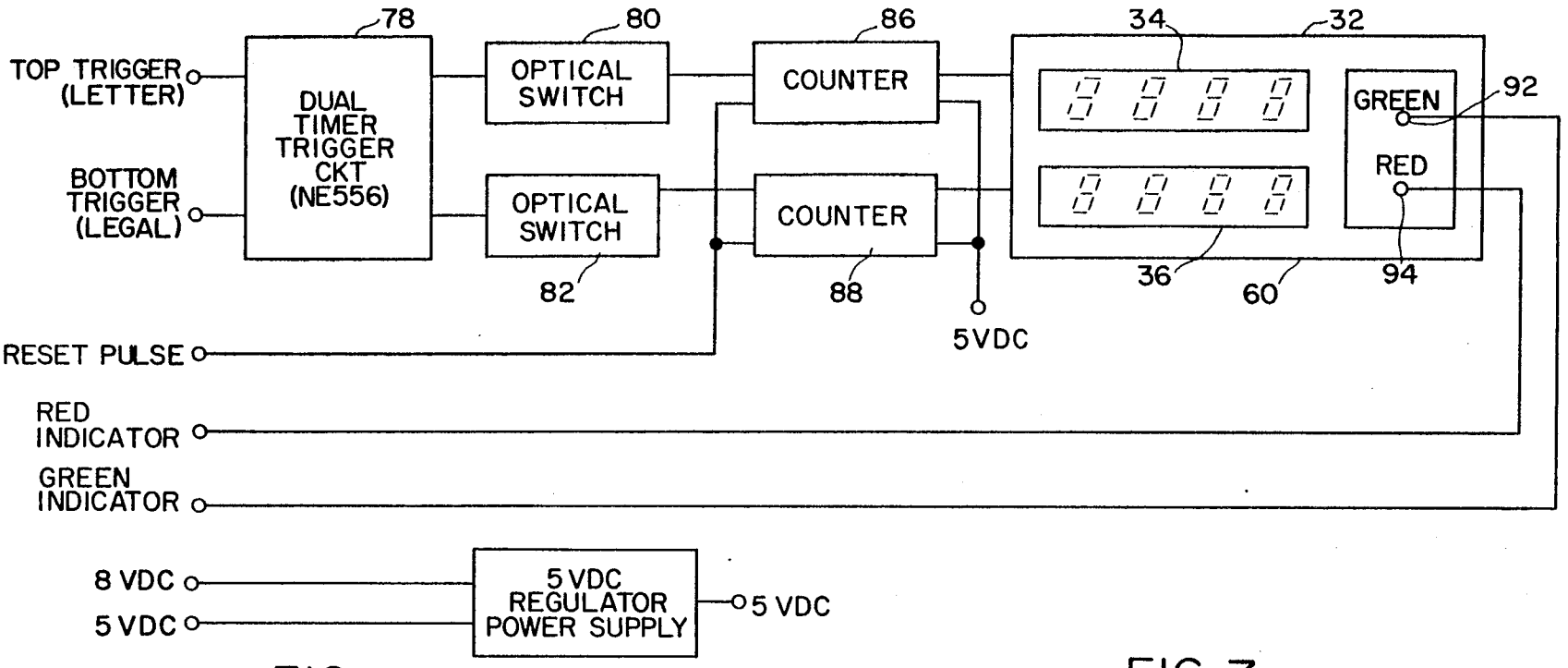
FIG. 6 is a block diagram of the counter and display circuit of the invention.
Figure 7:
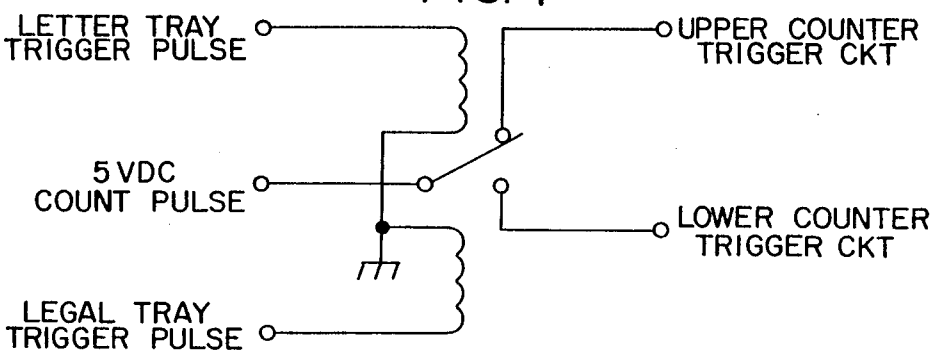
FIG. 7 is an interface circuit.

The display system has characters large enough to be easily readable from any practical distance. A four character seven segment display that has characters close to one inch in size is preferred. Dual display 32 (FIG. 6) has an upper display 34 for showing letter size copies and a lower display 36 showing a read-out for legal size copies. Four digit displays allows counts up to 9,999 which should be more than ample. The display will continue to count sequentially as long as the same customer continues to use the machine.

Figure 4:
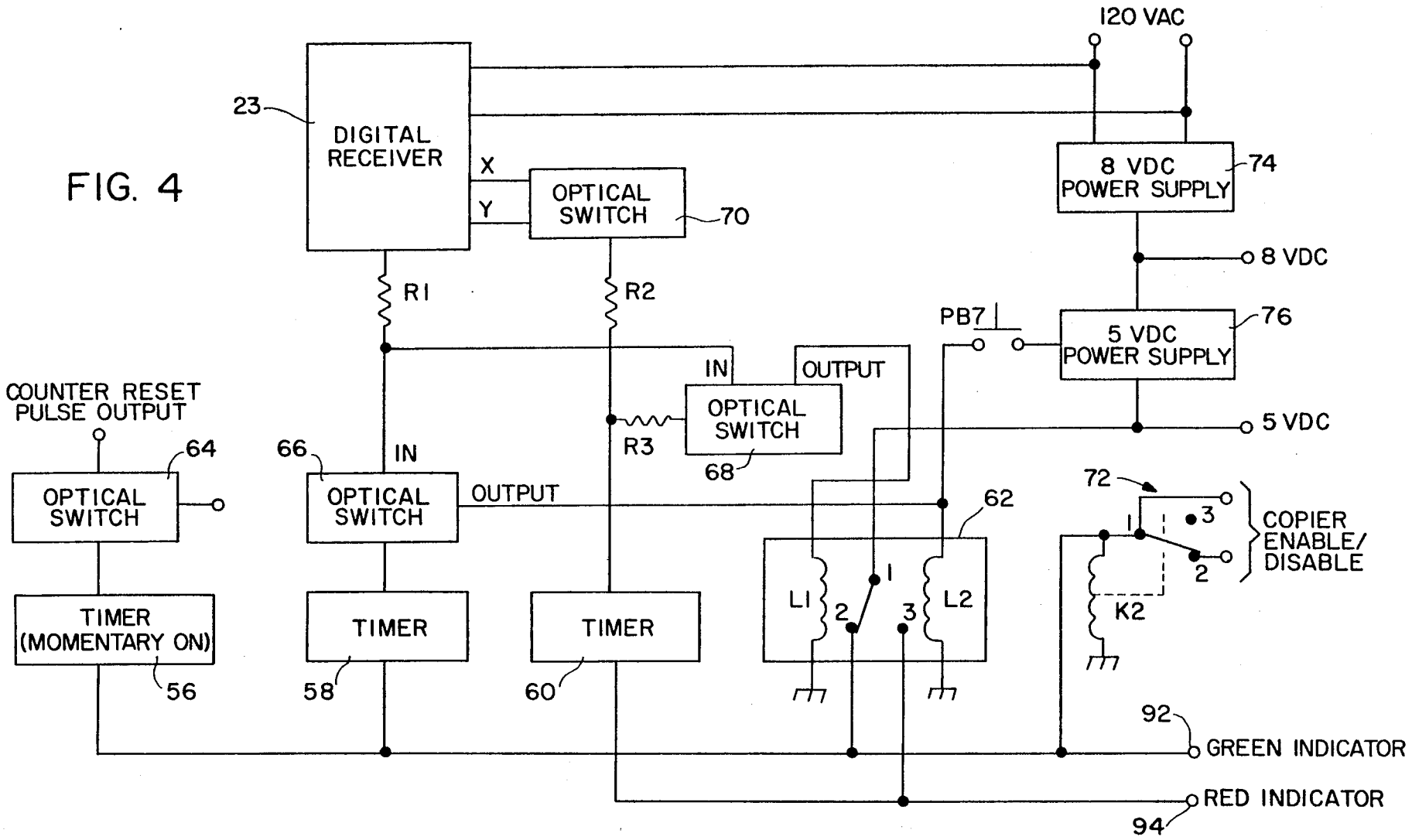
FIG. 4 is a schematic block diagram of the receiver and associated logic circuitory shown in FIG. 2.

The receiver and switching logic processing count pulses, paper size pulses and reset or hold pulses is shown in the simplified schematic block diagram of FIG. 4. Receiver 23 receives a digitally coded signal transmitted over the existing building electrical lines from transmitter 10, decodes this signal and produces an output to operate switching of logic circuit 25. For example a decoded reset signal activates momentary "on" timer 56 turning optical switch 64 on momentarily, causing a reset pulse to be sent to reset counters 86 and 88 clearing the four digit seven segment displays 34 and 36. A signal from the transmitter also switches the copier enable/disable relay 72 (K1) between open (copier disabled) when the copier is in a hold position and closed (copier enabled) when the copier counting system is reset allowing another customer to use the photo copier machine.

Receiver 23 is a single channel system designed to receive, decode, and discriminate between a binary coded 120 kHz pulse burst from transmitter 10 which is superimposed on the 60 cycle waveform of the existing building AC power line and a complementary inverted pulse waveform of the same binary code. Receiver 22 generates an electronic pulse train output only when it receives a specific coded signal of one waveform, or a complementary coded signal. Receiver 22 may optionally be programmed to receive a specific binary shop-code added (i.e. programmed) to IC 34 in transmitter 10 (FIG. 3). Receiver 22 will then only respond to that specific shop-code and no other. This portion of the binary code train identifies location.

Receiver 23 is programmed to respond to the specific binary code corresponding to the activation of any of the four numbered keys 12 on transmitter 10. When a numbered key on transmitter 10 corresponding to the particular photocopy machine selected is depressed and a transmit key, reset 14 or hold 16, is also depressed the transmitter will send an electronic pulse train to the machine selected. A hold pulse train will switch logic circuit 25 to a "hold" mode. When in the hold mode or enable mode receiver logic circuit 25 will only respond to a complementary coded signal of the previous code received. Receiver 23 will generate an electronic pulse train each time a machine is selected and either the "reset" or "hold" key is depressed. There will be no change in the switching logic circuit 25 if either key is depressed repeatedly. Likewise hold key (switch PB7) operated by the customer will be released if a reset pulse train is received from receiver 10.

The circuitry for counters 86 and 88 and dual four character seven segment displays are conventional. Counters suitable for use in the system are counters manufactured by Intersil Corp. or the like.

Trigger circuit 70 in the counter and display circuit is a dual NE556 timer receiving trigger pulses from routing relay 50 of interface circuit board of FIG. 5*a*. Output from these trigger circuits are delivered to optical switches 80 and 82 which in turn advance counters 86 and 88 to sequentially advance characters of the four digit seven segment displays 34,36. Outputs from the optical switches 80 and 82 are connected to the trigger inputs of counters 86 and 88 for the upper and lower displays 34 and 36.

Counter chips 86 and 88 are "reset" by receiving an output from optical switch 64 when a reset input from receiver 23. The reset is generated by transmitter 10 and delivered by receiver 23 to optical switch 68 to switch latching relay 62 from a hold position to a reset position. When a clerk wishes to reset a photocopier a pulse train is sent from transmitter 10, to receiver 23 and switching logic 25 which in turn results in a negative-going pulse applied to the counting chips 86 and 88, resetting them causing the digital displays to be cleared.

Trigger circuit 70 comprised of a NE556 dual timer triggers each counters 86 and 88 with a negative output pulse. Power is continuously applied to the dual timer keeping their outputs high. The outputs from optical switches 80 and 82 are low when the timer 78 outputs are high and are connected to trigger inputs of counting chips 86 and 88 grounding the inputs to keep the counting chips clamped. Clamping the counters prevents counts being caused by any background noise or spurious spikes in any of the counter circuits.

If either input of dual timer 78 is pulsed its output goes low, which in turn causes the related optical switch 80 or 82 to momentarily turn off resulting in a momentary high resistance across its output. This produces a count on the rising edge of the pulse and an increment on the related display read-out. By appropriate configuration of dual timer 78 the pulse output can be totally controlled in width and amplitude for purposes of this application. The pulse output is made as narrow as possible but still large enough to trigger a count increment in counters 86 and 88. The output pulses have a duty cycle consistent with the copy speed of the photocopy machine.

Transmitter 10 generates an electronic pulse train used to control switching logic at the receiver as shown in FIG. 4. Latching relay 62 will be closed (as shown) and green indicator light 92 will be illuminated indicating the associated photocopy machine is ready for use. Timer 58 turns on optical switch 66 for a short time allowing pulse to pass through. Also, timer 60 is off deactivating optical switch 68 and 70 preventing any pulse from receiver switching latching relay 62. Optical switch 70 will also be deactivated disconnecting inputs to X and Y to receiver which is now conditioned to only respond to a "hold" signal. Additionally power from latching relay 62 is applied to timer 58 which subsequently activates optical switch 66 allowing pulses from receiver 23 to pass through. Enable relay 72 will also be energized reactivating the photo copier "enable" circuit (not shown) making the photo copier operational.

An important feature of the invention is the switching logic circuit, shown in the schematic block diagram of FIG. 4. This circuit is a "change of state" circuit, which will keep a copy machine in an enabled or disabled mode until changed. When the receiver module switching logic circuit is in the reset mode it will remain that way until an opposite or complimentary coded signal is received from the transmitter. That is, when the copy machine is in a hold or disable mode it will remain that way until it receives a complimentary code. For example, when in the reset mode a change of state will only occur when a hold signal is generated by depressing the hold switch 16 on the transmitter, or hold switch 17 (PB7, FIG. 4) on the receiver module.

An additional function of the switching logic circuit is to reset the counters and the counter display and clear the display. Clearing the display is accomplished through momentary on timer 56 which turns on for a short time whenever latching relay 62 is activated by a coded pulse received through optical switch 68. This pulse is produced by selection of a copy machine and pressing the reset switch on the transmitter, causing a reset pulse to be sent to receiver 23. The reset coded pulse will provide an output from receiver 23 to optical switch 68, causing a voltage to be applied through latching relay 62 to timer 56 momentarily turning it on. This closes optical switch 64 allowing a 5 volt DC pulse output to the counter chips and displays. Timers 56, 58 and 60 are 555 timers connected to provide appropriate delays. Timer 56 is connected to provide a short on time delay to create a pulse from optical switch 64. Timers 58 and 60 are oppositely connected from timer 56 to provide a momentary delay before switching on. The particular time periods for the on and off delays of timers 56, 58 and 60 are selected by appropriate conventional resistor/capacitor (RC) circuits, (not shown).

Logic switching circuit of FIG. 4 switches a selected copier to a hold or disabled condition by generating a disabled coded pulse produced when the hold switch is depressed on the transmitter, or a similar pulse produced by switch PB7 in logic switching circuit. When a hold pulse is generated by the transmitter it provides an output at the receiver 23 through optical switch 68 applying a voltage to the red indicator light and timer 60. Power to relay 72 is now removed causing the relay to switch off opening the copier enable/disable circuit preventing use of the copy machine. This effectively prevents any pulse outputs to the counter and display circuits freezing the entire operation. At this time optical switch 70 is activated through timer 62, after a short delay, and shorts inputs X and Y to receiver 23 preventing any response by the receiver to any signal other than a reset or enable signal from the transmitter. If the hold or disable switches on the transmitter, or receiver module, are now pressed it will have no effect on the logic switching circuit as the latching relay 62 will remain in the disable position. Only an enable or reset coded pulse from the transmitter will change the state of latching relay 62.

When a reset or enable pulse signal is transmitted by pressing reset switch 14 on the transmitter receiver 23 applies the pulse to latching relay 62 through optical switch 68. Latching relay will then switch from pin 3 to pin 2 applying a 5 volt output to green indicator light and also to relay 72 and momentary on timer 56. This causes a pulse to be produced from optical switch 64 to reset the counter chips clearing the displays. A reset pulse can only be applied to the logic switching circuit from the transmitter by a shop clerk. The customer has no control or ability to reset the copy machine once it is placed in a disable condition.

With latching relay 62 now connected to pin 2 timer 60 will turn off causing optical switches 68 and 70 to also turn off. With optical switch 70 off inputs X and Y to receiver 23 are open, conditioning receiver 23 to only respond to a complimentary signal from the transmitter. Thus, receiver 23 will now only respond and send a pulse when hold switch on the transmitter is activated.

With latching relay connected to pin 2 timer 58 is activated after a short delay activating optical switch 66. Optical switch 66 will then allow a hold pulse transmitted by receiver 23 to switch latching relay 62 to the opposite or disable position.

Timers 58 an 60 provide the function of preventing switching overlap between optical switches 66 and 68 when they switch. When latching relay 62 switches from pin 2 to pin 3 a voltage is applied to timer 60 and removed from timer 58, causing timer 58 to shut off which deactivates optical switch 66. Timer 60 will remain off for a short delay determined by an appropriate conventional RC circuit value then switch on turning optical switches 68 and 70 on.

When a reset signal is next received from the transmitter by pressing reset switch 14 an output from receiver 23 will be applied to latching relay 62 through optical switch 68 which reverses the operation of the system. Timer 58 is energized and turns on after a short delay with timer 60 being shut off preventing any switching overlap between optical switches 66 and 68.

As described previously timer 56 is connected to produce a positive pulse of short duration from optical switch 64 when power is applied to it from contact pin 2 of latching relay 62. The pulse generated by turning optical switch 64 on for the short period of time determined by timer 56 occurs only when switching from a hold (disabled) to a reset (enabled) condition.

Interface module 24 has two special functions. The first function is to receive a count trigger pulse from the photocopy machine and to condition it so it is suitable to trigger a count on the digital counter and display. Secondly, interface relay 50 switches count trigger pulse to either the upper or lower counter to display letter or legal size copy count according to the paper tray selected. The interface provides these functions by receiving and conditioning copy pulses to produce an output having a constant voltage and polarity. Each time the interface paroduces an output pulse the display indicates that a copy has been made. Pulses to switch relay 50 are obtained from paper tray switching circuitry when the photocopy machine is switched from one copy size to another.

Alternately where direct connection is not possible either because of warranties or difficulty in making the circuit connection photo sensitive devices can be used to produce the pulse. A suitable photo conductor is placed very close to the light source which turns on only when the copier is in the legal size mode. Further, if it is not possible to position photodetectors close enough to the light source being activated then optical fibers may be used to conduct light from letter or legal size mode light source to the photodetector. The latter method is effective where it is difficult to place photodetectors close to the light source of the photo copier.

Transmitter 10 shown in FIG. 1 is a four station transmitter. However, a transmitter can be configured to control eight, twelve, sixteen photocopiers or more with the addition of more transmitters if necessary. Transmitter 10 can be at any location in a shop and where there is a 120 volt AC existing power line plug. No other wiring or connections are required. The transmitter usually will be placed near the cash register so a clerk can easily control the photo copier from the position where payment for copies is collected. Transmitter 10 is also sufficiently compact and portable that it may be transferred to any convenient location in the shop and plugged into a 120 volt AC outlet making it immediately ready for use. When activated, transmittor 10 sends a discreet digital code over existing building power lines to receiver 22 at each photo copier. Numbered keys on the transmitter represent a photo copier identified by a specific digital code. When a key is activated the code sent will be recognized only by the receiver at the copy machine selected which is pre-programmed to receive only that specific digital code. A received code causes receiver 22 to emit an electronic pulse train.

Transmitter 10 also sends a second digitally coded signal in sequence with the key signal designed to identify the location of the system called a "shop code". A transmitter generally can be programmed with any of sixteen location-codes. The receivers at each photocopier are programmed to receive and respond to only specific location codes. A receiver which has been programmed to respond to one location code will not respond to another location code. This effectively prevents interference between two or more adjoining systems.

Transmitter 10 simulates two distinct channels. For example, if a photocopier key selection is depressed and the reset key is depressed a digitally coded signal will be sent to the particular photocopier selected. If that key selecting that photo copier is again depressed and the "hold" key depressed transmitter 10 will again send a digitally coded signal but it is an inverted and complementary coded signal of the coded signal sent when then "reset" key was depressed. Receiving and switching logic at each photo copier is therefore designed to receive and respond individually to each of these two complementary coded signals. The receiver will receive and respond to a selection-reset signal, but will not respond if the same reset signal is again sent. Each receiver will only respond to a change in condition from reset to hold, or back to reset.

To operate the system a customer will select a machine in a reset condition with the green light at the display illuminated. The customer will then make his copies which are recorded on the display. The display will indicate the number of legal or letter size copies made. The customer may switch from legal to letter size as many times as he wishes and the system will respond to these changes and record the number of copies. When the customer has finished making his copies he simply pushes the hold button to disable the machine to prevent another customer from increasing his copy count. The customer then takes the copies to the register where the clerk will accept payment or record the number of copies by reading the clearly visible display. When the transaction is complete the clerk will reset the photocopier which has been used by pressing the copier select key and depressing the reset key restoring the photocopier for use by the next customer. Activation of the reset key also clears the display.

A system has been disclosed which allows a clerk to control operation of one or more photocopy machines from a remote location and provide an accurate count of the number of copies made. The system is fool proof in that the customer may not in any way effect the copy count.

This invention is not to be limited by the embodiment shown in the drawings and described in the description which is given by way of example and not of limitation, but only in accordance with the scope of the appended claims.

What is claimed is:

1. A copy counting system for counting and visibly displaying the number of copies to a customer and a cashier comprising:

transmitter means for remotely transmitting control signals to one or more copy machines; receiver means connected to each of said one or more copy machines for responding to signals from said transmitter means;

connecting means connecting said remote transmitting means to said receiver means through exciting electrical wiring;

interface means for interfacing said receiver means with an electric signal in each of said one or more copy machines produced when a photocopy is made; said interface means generating an output pulse for each photocopy made on each of said one or more copy machines;

digital display means connected to each of said interface means for receiving said output pulses; said digital display means providing a digital display of the number of copies made by each of said one or more copy machines;

said digital display means being mounted to be clearly visible to both a customer and cashier;

said remote transmitting means including means for resetting each individual digital display means at each of said one or more copy machines to zero;

whereby said cashier may reset said digital display means of one of said one or more copy machines after accounting for the number of copies made.

2. The system according to claim 1 in which said transmitter means includes hold means for sending a hold signal to said receiver means to disable said copy machine until signal display means have been cleared;

whereby use of said copy machine is prevented after a copy run has been completed until the copies made have been accounted for.

3. The system according to claim 2 including logic circuit means connected to said receiver means for controlling operation of said copy;

said logic circuit means including circuit means for disabling said copy machine when a reset signal is received from said transmitter means.

4. The system according to claim 3 in which said logic circuit means includes switch means for disabling said copy machine by a user when a copy run has been completed.

5. The system according to claim 4 in which said logic circuit means includes a latching relay;

means switching said latching relay from a first position enabling said copy machine to a second position disabling said copy machine.

6. The system according to claim 5 in which said display means includes indicator lights receiving an output from said latching relay;

said indicator lights indicating the enable or disable condition of said copy machine.

7. The system according to claim 6 in which there are two indicator lights;

one of said indicator lights being green to indicate said copy machine is enabled;

the other of said indicator lights being red to indicate said copy machine is disabled.

8. The system according to claim 1 which said digital display means is a multiple digital display means;

each of said displays connected to indicate the number of different size copies made on said copy machine.

9. The system according to claim 8 including copy size detecting means in said interface circuit for detecting the copy size selected.

10. The system according to claim 9 including routing means for routing output pulses indicating copy activation to the display for the particular paper size of the copies being made.

11. The system according to claim 10 in which said display means includes a dual timer trigger circuits;

said dual timer trigger circuit receiving the switched output from said routing means;

and counting means incrementally advising said digital display when a count pulse is received from said one of said dual timer trigger circuit;

whereby the digital display for the selected paper size will be incrementally advanced each time a copy is made.

12. The system according to claim 1 in which said interface means comprises;

means for detecting a pulse whenever a copy is made on said machine;

signal processing means for processing said pulse to produce an output pulse of constant voltage and polarity.

13. The system according to claim 12 in which said means for detecting a pulse comprises photoconducting means;

said photoconducting means being mounted near a light source on said copy machine which illuminates whenever a copy is made;

said photoconductor producing an output pulse to said signal processing means.

14. The system according to claim 12 in which said means for detecting a pulse comprises means connected directly said copy machine circuitry for receiving signals sent whenever a copy is made on said copy machine;

said directly connected means including means for receiving inputs up to 120 volts AC or DC.

15. The system according to claim 14 in which said directly connected means includes rectifying means;

and voltage regulating means for receiving and rectifying said copy machine output voltage and providing a regulated low voltage output.

16. The system according to claim 15 in which said transmitter means has a plurality of momentary push button switches;

selected switches of each of said plurality of switches being numbered and connected to transmit a code for a selected copy machine;

one of said switches being connected to send a code to disable the selected copy machine;

another of said switches being connected to send a reset and enable code to reset the display and enable said copy machine.

17. The system according to claim 1 in which said display is selected to be visible from a distance and mounted to be visible by an operator of said transmitter means.

18. The system according to claim 17 in which said transmitter means includes an indicator light to indicate transmission of a code whenever one of said switches is energized.

19. The system according to claim 18 in which said transmitter means includes a shop code transmitted to the selected receiver whereby said receiver will only respond to signals from a transmitter having its shop code.

20. The system according to claim 19 in which said transmitter and said plurality of receivers are constructed to communicate through existing structure electrical wiring whereby said transmitter means and receiver means my communicate by being plugged in any convenient available electrical plug.

* * * * *